US006860076B2

(12) United States Patent
Heinemann

(10) Patent No.: US 6,860,076 B2
(45) Date of Patent: Mar. 1, 2005

(54) COVERING ARRANGEMENT FOR A BUILDING, AND COVERING PART FOR USE IN SUCH A COVERING ARRANGEMENT

(76) Inventor: Torsten Heinemann, Eichbergstr. 51, D-75331 Engelsbrand-Grunbach (DE)

( * ) Notice: Subject to any disclaimer, the term of this patent is extended or adjusted under 35 U.S.C. 154(b) by 0 days.

(21) Appl. No.: 09/939,295

(22) Filed: Aug. 24, 2001

(65) Prior Publication Data

US 2003/0037503 A1 Feb. 27, 2003

(51) Int. Cl.[7] ..... E04D 1/00; E04D 3/00

(52) U.S. Cl. ..... 52/536; 52/538; 52/542; 52/478

(58) Field of Search ..... 52/478, 536, 538, 52/542, 519, 539, 551, 309.8, 309.9

(56) References Cited

U.S. PATENT DOCUMENTS

| | | | | | |
|---|---|---|---|---|---|
| 651,873 | A | * | 6/1900 | Ludowici | 52/533 |
| 941,358 | A | * | 11/1909 | Conover | 52/538 |
| 1,370,716 | A | * | 3/1921 | Tromm | 52/538 |
| 1,427,698 | A | * | 8/1922 | Poliakoff | 164/419 |
| 1,976,768 | A | | 10/1934 | Sheldon | |
| 1,976,968 | A | | 10/1934 | Sheldon | |
| 3,284,967 | A | * | 11/1966 | Elliot | 52/58 |
| 3,626,439 | A | * | 12/1971 | Kneisel | 52/183 |
| 3,771,271 | A | * | 11/1973 | Keel | 52/478 |
| 4,015,392 | A | * | 4/1977 | Eaton | 52/533 |
| 4,195,459 | A | * | 4/1980 | Anderson | 52/394 |
| 4,292,781 | A | * | 10/1981 | Chalmers et al. | 52/547 |
| 4,754,589 | A | * | 7/1988 | Leth | 52/538 |
| 4,862,665 | A | * | 9/1989 | Kneisel | 52/539 |
| 5,502,940 | A | * | 4/1996 | Fifield | 52/309.12 |
| 5,974,756 | A | * | 11/1999 | Alvarez et al. | 52/553 |
| 6,233,895 | B1 | * | 5/2001 | Evans et al. | 52/518 |
| 6,298,626 | B2 | * | 10/2001 | Rudden | 52/520 |

FOREIGN PATENT DOCUMENTS

| | | |
|---|---|---|
| DE | 2 250 555 | 4/1974 |
| DE | 25 25 130 | 12/1975 |
| DE | 25 14 981 | 10/1976 |
| DE | 25 31 220 | 2/1977 |
| FR | 2 655 078 | 5/1991 |

* cited by examiner

*Primary Examiner*—Robert Canfield
(74) *Attorney, Agent, or Firm*—Factor & Lake

(57) ABSTRACT

A covering arrangement for a building has parallel elongate supports and covering parts arranged thereon. The covering parts include a core and, connected thereto, upper covering elements and lower planar covering elements, with the result that a sandwich is formed. The covering parts furthermore have an elongate, striplike form and in the installed position are arranged transversely to supports, extending at least from one support to a neighbouring support. In order to increase the resistance to wind loads, it is proposed that a longitudinal border region of a covering part (16) include a connecting device and the opposite longitudinal border region of a neighbouring covering part has a connecting device complementary thereto, by means of which the two covering parts are firmly connected to each other.

9 Claims, 6 Drawing Sheets

COVERING ARRANGEMENT FOR A BUILDING, AND COVERING PART FOR USE IN SUCH A COVERING ARRANGEMENT

The present invention relates to a covering arrangement for a building, the arrangement having parallel elongate supports and, arranged on the supports, covering parts which a) comprise a core and, connected thereto, upper and lower planar covering elements in the manner of a sandwich, b) have an elongate, striplike form, c) in the installed position are arranged transversely to the supports and extend at least from one support to a neighbouring support.

The subject matter of the present invention is also a covering part for use in such a covering arrangement, which a) comprises a core and, connected thereto, upper and lower planar covering elements in the manner of a sandwich and b) has an elongate, striplike form.

A covering arrangement of the type mentioned at the outset is known on the market. The covering parts used are sandwich elements with metal covering panels which are spaced apart from each other and between which a thermal insulating material is arranged. The known covering parts are used, for example, as facade elements or for roof coverings. The covering parts are fastened to the underlying supports by a screwed connection. This has the disadvantage that when such a screwed connection fails, due to corrosion for example, the known covering part may become detached at one border, which increases the contact surface for the wind and may possibly result in the known covering part being torn off, for example in a storm.

The object of the present invention is therefore to develop a covering arrangement of the type mentioned at the outset in such a way that its life is as long as possible and detachment of the covering parts from the supports is reliably prevented even in a storm.

This object is achieved in that d) a longitudinal border region of a covering part has a connecting device and the opposite longitudinal border region of a neighbouring covering part has a connecting device complementary thereto, by means of which the two covering parts are firmly connected to each other.

Such a connection of the covering parts to one another prevents the possibility, in the event of a failure of the fastening to the supports, of individual covering parts being lifted by a wind load and eventually being torn off completely. This is advantageous particularly in the case of very light sandwich elements which have, for example, only a sheet or a surface coating as covering elements and which could be particularly easily lifted by a gust of wind owing to their low mass.

An advantageous development of the covering arrangement according to which the covering arrangement is a roof and the supports are the rafters of a roof.

The object of the present invention is also to develop a covering part of the type mentioned at the outset in such a way that it can be produced inexpensively and connected in a storm-proof manner to a substructure. This object is achieved in that c) its one longitudinal border region has a connecting device and its opposite longitudinal border region has a connecting device complementary thereto, such that the covering part can be firmly connected to an identical covering part at, in the installed position, mutually facing longitudinal border regions.

Advantageous developments of such a covering part are specified in the claims.

A connecting device which is simple to produce and, moreover, is simple to handle during the production of the covering arrangement according to the invention is specified in claim 4. According to this, the connecting devices comprise at least one catch projection and a catch recess complementary thereto.

It is also advantageous when, the two connecting devices in the installed position cooperate in the manner of a hinge, the pivot axis running substantially parallel to the longitudinal axis of the covering part. In this way, building surfaces, in particular roofs, sections of which have different relative angular positions can be realised.

The stability of the covering part according to the invention is increased by the development according to which at least one of the connecting devices is integrated into a stiffening member arranged in the region of the corresponding longitudinal border region of said covering part.

A high security of connection is achieved when the connecting devices each extend over the entire length.

The development of the invention specified in claim 8, in which the connecting devices are designed in such a way that, in the installed position, the mutually facing longitudinal border regions of neighbouring covering parts overlap, is visually favourable and important for a good seal between two covering parts according to the invention. The seal created by this means is further improved by the developments specified in the claims according to which one of the longitudinal borders of the covering part is drawn down and up, respectively.

According to the development of the invention at least one of the connecting devices has a plurality of connecting positions, such that the relative position of the covering part with respect to a neighbouring covering part can be varied. This has the advantage that different dimensions of a building surface can be covered in a simple way with identical covering parts without having to cut the covering parts to size.

The connecting device can also be used for connection to a snow fence and/or a ladder and/or steps and/or a flashing.

Several exemplary embodiments of the invention will be explained in detail below with reference to the accompanying drawing, in which.

Figure 1:
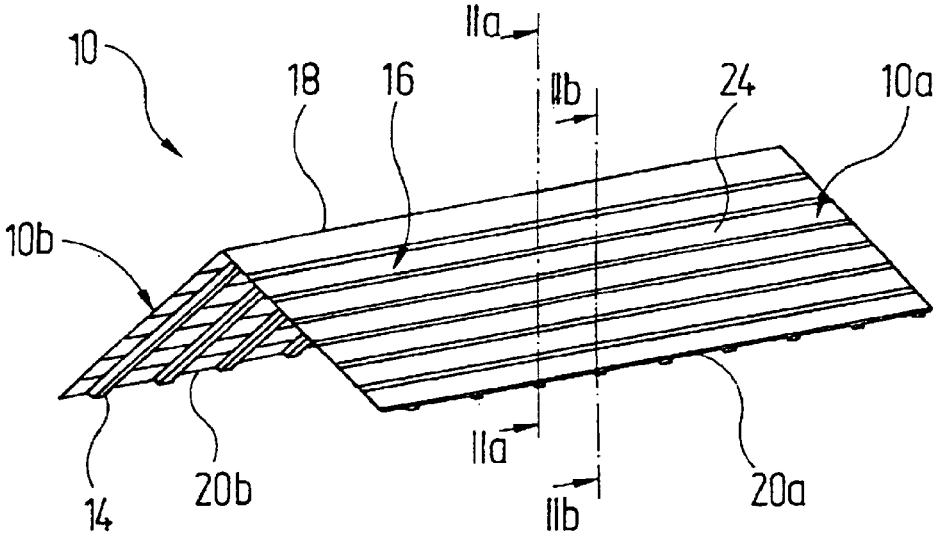
FIG. 1 shows a perspective representation of a first exemplary embodiment of a covering arrangement for a building.

In FIG. 1 a covering arrangement for a building bears the reference numeral 10 as a whole. The covering arrangement 10 in the present case is a building roof which has, as the parallel elongate supports, rafters 14 and covering parts 16 arranged thereon. In an exemplary embodiment which is not illustrated, the covering arrangement may also be the outside wall of a building.

The covering parts 16 have an elongate, striplike form, are arranged, in the installed position, transversely to the rafters 14 and extend from one gable end to the other gable end of the roof 10. The roof 10 is a ridge roof with two roof halves 10*a* and 10*b*, each extending from a ridge 18 to eaves 20*a* and 20*b*, respectively. Arranged between ridge 18 and eaves 20*a* and 20*b*, parallel to the course of the ridge 18, are in each case seven identical covering parts 16.

Figure 2:
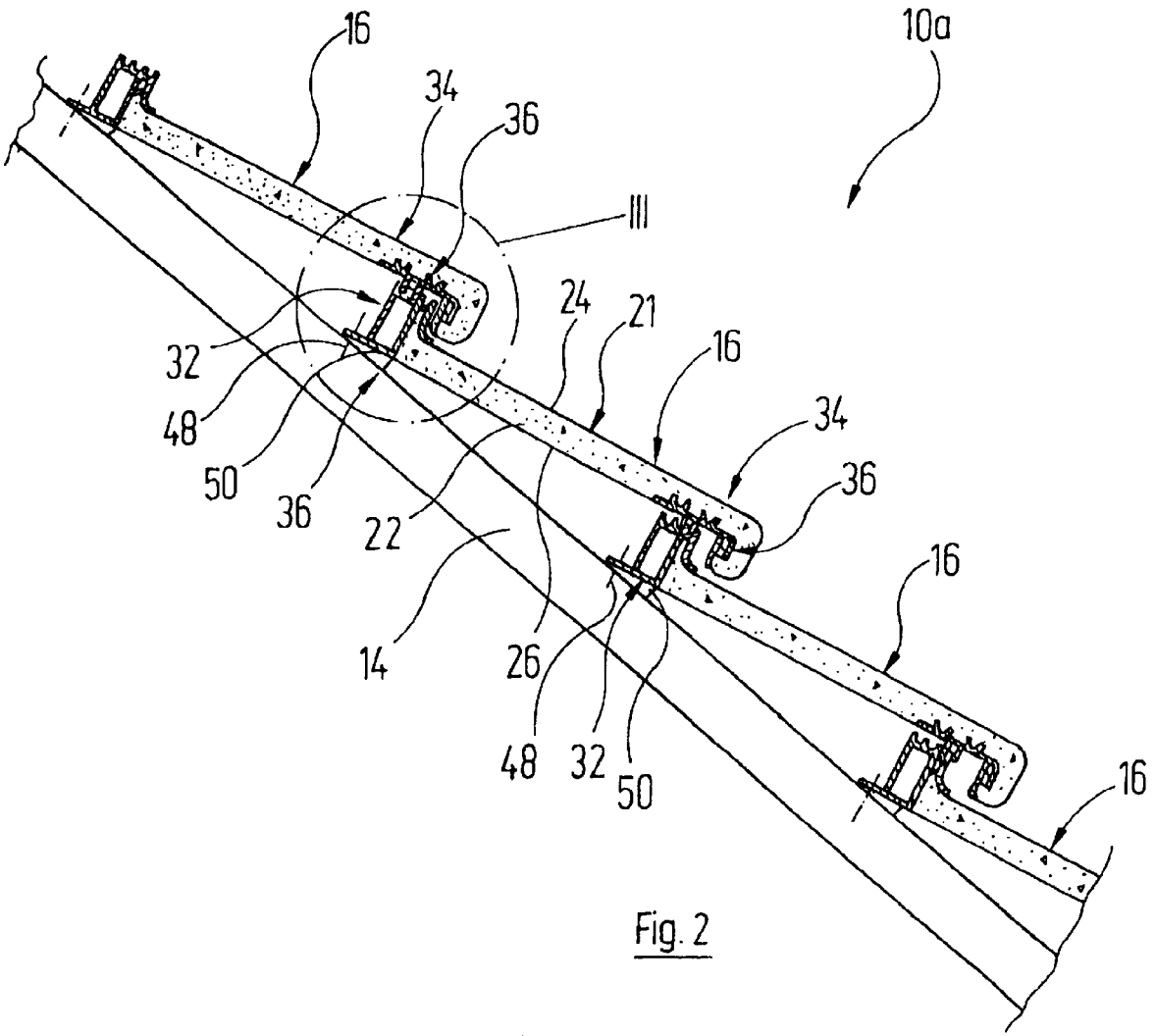
FIG. 2 shows a partial section in the plane defined by the lines IIa—IIa and IIb—IIb of FIG. 1.

As can be seen from FIG. 2, the covering parts 16 each comprise a central section 21 with a core 22 made of polyurethane foam, and also with an upper planar covering element 24 and a lower planar covering element 26, with the result that the central section 21 is constructed in the manner of a sandwich. Both covering elements 24 and 26 consist of a PVC sheet. Arranged between the upper PVC sheet 24 and the core 22 is a supporting element 28 composed of a thin perforated metal sheet (cf. FIG. 3), which gives the upper side of the covering part 16 a certain rigidity to impact loads.

Figure 3:
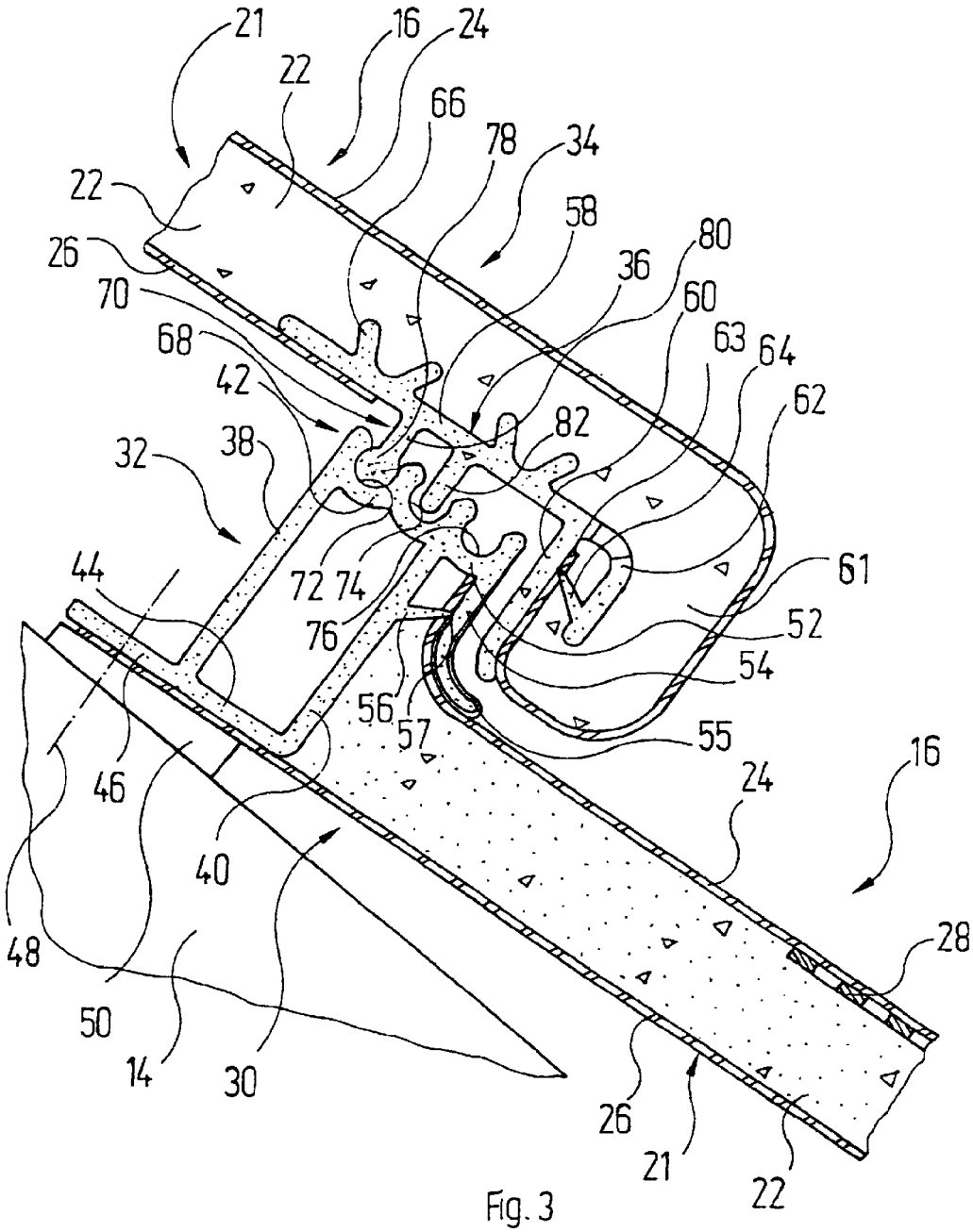
FIG. 3 shows a detail view III of FIG. 2.

Arranged at the, in FIGS. 2 and 3 left-hand, border region 30 of the covering part 16 is a stiffening member 32 having a rectangular hollow section, whereas in the right-hand border region 34 of the covering part 16 there is provided an open stiffening member 36 forming, as a whole, a right angle. The two stiffening members 32 and 36 are produced from a recycled wood material.

Owing to the fact that the perforated metal sheet 28 arranged beneath the upper PVC sheet is mechanically decoupled from the rigid stiffening members 32 and 36 of the covering part 16, its thermal expansions have no effect on the overall dimensions of the covering part 16. The thermal expansions of the remaining regions of the covering part 16 are very low, since they are produced entirely from plastic and recycled wood material. This reduces possible thermal stresses in the covering part 16 and increases the life thereof. But it also prevents the substructure (i.e. the rafters 14) from being overloaded and the formation of gaps between neighbouring covering parts 16.

In an exemplary embodiment which is not illustrated, the stiffening members comprise a unidirectional fibre material arranged in the longitudinal direction.

The stiffening member 32 has two webs 38 and 40 (cf. FIG. 3) which are perpendicular to the plane of the covering part 16 and connected to each other by flanges 42 and 44 parallel to the plane of the central section 21. The webs 38 and 40 are approximately twice as high as the thickness of the central section 21 (or the distance between the PVC sheets 24 and 26). The lower flange 44 lies approximately in the plane of the lower PVC sheet 26, which is welded to its outside. A strap 46 pointing away from the central region is integrally formed on the lower flange 44. The strap 46 is screwed to the respective rafter 14 by a screw 48, illustrated merely by a dot-dash line in FIGS. 2 and 3, and via an angle-compensating wedge 50.

The upper flange 42 of the stiffening member 32 has an extension 52 which extends parallel to the plane of the central section 21 and towards the latter. A connecting section 54, running substantially downwards in FIGS. 2 and 3, the free edge 55 of which is curved towards the central section 21, is integrally formed on the free edge of the extension 52. The upper PVC sheet 24 is welded to the side of the connecting section 54 facing the web 40 of the stiffening member 32. Integrally formed on the outside of the right-hand web 40 is a clamping strip 56 which points obliquely upwards towards the connecting section 54 or the upper extension 52 and between the tapering edge 57 of which and the connecting section 54 the upper PVC sheet 24 is additionally clamped.

The stiffening member 36 in the right-hand border region 34 of the covering part 16 is constructed as follows: it comprises a straight base section 58 which is oriented substantially parallel to the plane of the central section 21 of the covering part 16 and welded, in its left-hand border region, to the lower PVC sheet 26 of the covering part 16, whereas its border region on the right in FIGS. 2. and 3 is integrally connected to a connecting section 60 perpendicular to the plane of the central section 21 of the covering part 16 and extending downwards in the installed position shown in FIG. 3. The outside of the connecting section 60 is welded to the border of the upper PVC sheet 24 of the covering part 16, such that the right-hand border region 34 of the covering element 16 has a bend 61 angled downwards, as a whole, by 90° from the plane of the central section 21.

On the base section 58 of the stiffening member 36 there is, furthermore, integrally formed an extension 62 which runs parallel to the connecting section 60 and is spaced somewhat therefrom. A clamping strip 64 having a tapering edge 63 extends from the extension 62 towards the connecting section 60, such that the border of the upper PVC sheet 24 is clamped between the edge 63 of the clamping strip 64 and the surface of the connecting section 60 lying opposite thereto. On the base section 58 there are, furthermore, integrally formed, towards the core 22 of the covering part 16, obliquely protruding anchoring elements 66 which ensure secure anchorage of the stiffening member 36 in the core 22.

As a result of the said design and arrangement of the stiffening member 32, the left-hand border region 30 of the covering part 16 is drawn upwards by about 90°. The right-hand border region 34 of the covering part 16 is, in contrast, drawn downwards, as a whole, by about 90° by the bend 61. In the installed position illustrated in FIGS. 2 and 3, two neighbouring covering parts 16 are arranged in such a way that these end regions 30 and 34 overlap and engage behind each other.

The webs 38 and 40 of the stiffening member 32 which run perpendicular to the planes of the covering parts 16, and the connecting section 60 which likewise runs perpendicular to the plane of the covering part 16, and the extension 62 of the stiffening member 36 give the covering part 16 the necessary flexural strength for the operating loads (snow, wind, etc.) to be expected, which the extremely light, but not very rigid composite structure composed of upper PVC sheet 24, lower PVC sheet 26 and core 22 would lack on its own.

The two stiffening members 32 and 36 each have mutually complementary connecting devices 68 and 70, by which the parts 16 can be connected to each other. The connecting device 68 provided on the stiffening member 32 consists of three cylindrical and mutually identical catch recesses 72, 74 and 76 which are formed one beside the other in the upper side of the upper flange 42 and run in the longitudinal direction of the stiffening member 32. The connecting device 70 of the stiffening member 36 consists of a cylindrical catch protuberance 78 which is complementary to each of the catch recesses 72, 74, 76, likewise extends in the longitudinal direction of the stiffening member 36 and is integrally formed on the base section 58 via a connecting web 80 perpendicular to the base section 58 of the stiffening member 36.

The opening width of the catch recesses 72, 74 and 76 and the width of the connecting web 80 of the catch protuberance 78 are coordinated with each other in such a way that the covering part 16 at the top in FIGS. 2 and 3 can be tilted in the manner of a hinge with respect to the corresponding lower covering part 16 in a certain angular range about the longitudinal axis of the catch protuberance 78 and of the corresponding catch recess 72, 74 and 76. In this way, roof surfaces with sections of different inclination can be realised. The dimensions of the stiffening members 32 and 36, and also of the connecting devices 68 and 70, are in this case coordinated with each other in such a way that, in the installed position, a gap is present between the stiffening members 32 and 36 and in particular between the connecting section 60 of the stiffening member 36 and the connecting section 54 of the stiffening member 32, the function of which gap will be discussed in more detail hereinbelow.

By providing three catch recesses 73, 74 and 76 running parallel to one another, it is possible to vary the relative position of a covering part 16 with respect to a neighbouring covering part 16 and thereby cover any roof sizes with identical covering parts 16 without one or more covering parts 16 having to be cut to size accordingly. This can be seen particularly well from FIG. 2: the covering parts 16 illustrated in this figure are all in different relative positions to the respectively neighbouring covering part 16.

In an exemplary embodiment which is not illustrated, instead of the catch protuberance and catch recess hooks curved in the shape of a quarter circle and correspondingly shaped recesses may be employed, ensuring a more secure connection of neighbouring covering parts.

The mutual connection of neighbouring covering parts 16 prevents the wind from getting under a lightweight covering part 16 and tearing it off. In this way, a storm-proof roof-covering arrangement 10 is created. The penetration of snow and moisture is also effectively prevented.

Integrally formed on the base section 58 of the stiffening member 36, parallel to the connecting web 80, is a clamping web 82 which likewise extends over the entire length of the stiffening member 36. The position, width and length of the clamping web 82 are dimensioned in such a way that, in the installed position illustrated in FIG. 3, in which the catch protuberance 78 of the stiffening member 36 is caught in the catch recess 72 of the stiffening member 32 furthest to the left, it penetrates into the middle catch recess 74, while leaving a free space between the clamping web 82 and the wall of the middle catch recess 74.

In this way, it is possible to pass a flashing, not illustrated in the drawing, for example of a skylight, a lead-in for a satellite dish, etc., through the gap between the two connecting sections 54 and 60 and to clamp it between the clamping web 82 and the middle catch recess 74. An absolutely moisture-tight connection of such a flashing to the covering parts 16 is thus ensured in a simple way.

Figure 6:
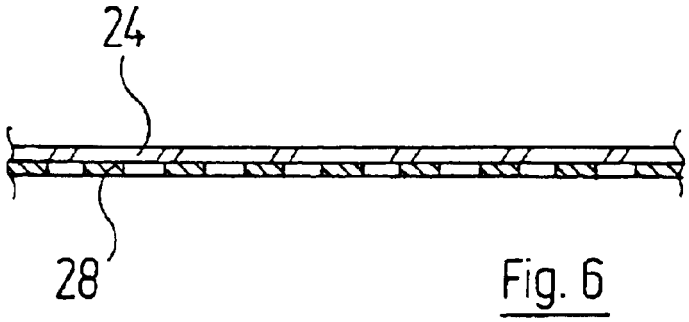
FIG. 6 shows a section through a covering element and a supporting element at a first point in time during the production of a covering part.

The covering part 16 illustrated in FIG. 3 is produced as follows:

First of all, the upper PVC sheet 24, which is in the form of a continuous material, is welded to the supporting element 28, which is likewise in the form of a continuous material. This is illustrated in FIG. 6.

Figure 7:
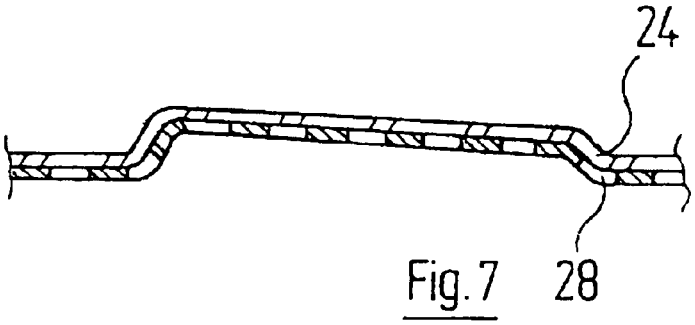
FIG. 7 shows the covering element and the supporting element of FIG. 6 at a second point in time during the process for the production of the covering part of FIG. 6.

Then, the composite structure composed of upper PVC sheet 24 and supporting element 28 is plastically deformed by a roll, thereby creating the desired surface structure. This may, for example, be the surface structure of a plain tile pattern or of a clinker brick, etc. The result of this step is illustrated in FIG. 7.

Figure 8:
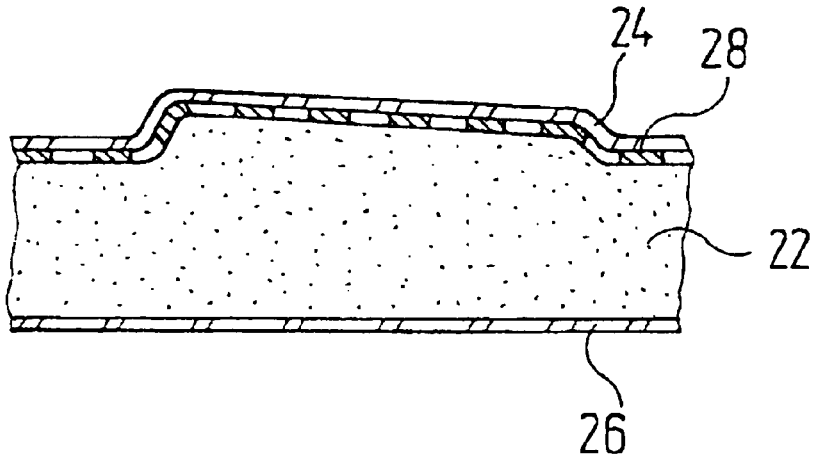
FIG. 8 shows the covering element and the supporting element of FIG. 6 at a third point in time during the process for the production of the covering part of FIG. 6.

Now, the stiffening members 32 and 34 (not illustrated in FIGS. 6 to 8) are likewise produced as continuous parts and the longitudinal borders of the PVC sheets 24 and 26 are connected to the stiffening members 32 and 36 in a continuous process. This may be effected, for example, by pushing the borders of the PVC sheets 24 and 26 in between the clamping strips 56 and 64, respectively, and the connecting section 54 and 60, respectively, with the aid of a press-roll or, for example, using compressed air. To achieve optimal retention, the PVC sheets 24 and 26 are additionally welded to the stiffening members 32 and 36 as well.

Subsequently, the PU foam of the core 22 is introduced into the hollow space created between the two PVC sheets 24 and 26 and the two stiffening members 32 and 36. The composite structure composed of the two PVC sheets 24 and 26, the two stiffening members 32 and 36 and the still warm and thus soft PU core 22 is now passed through a die (not illustrated in the figure) corresponding to the desired cross-section of the covering part 16 and cooled in the process. In this way, the desired covering part 16 is produced in a continuous process (cf. FIG. 8).

Figure 4:
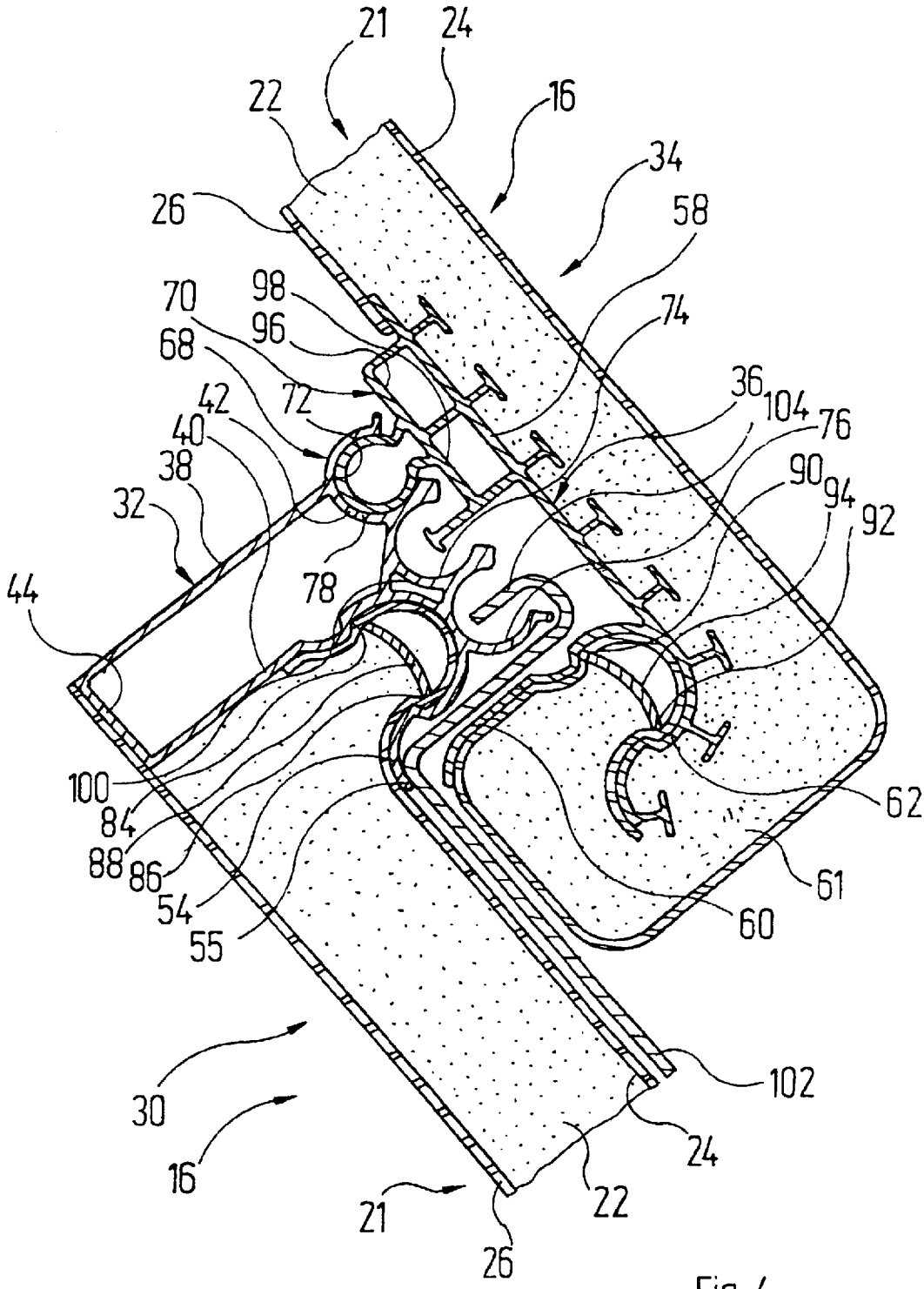
FIG. 4 shows a representation similar to FIG. 3 of a second exemplary embodiment of a covering arrangement.

A second exemplary embodiment of a covering part 16 is illustrated in FIG. 4. Parts which are functionally equivalent to those parts already described in connection with the first exemplary embodiment bear the same reference numerals and are not explained in detail here once again.

An essential difference to the previous exemplary embodiment concerns the connection of the upper PVC sheet 24 to the respective stiffening members 32 and 36: welding is completely dispensed with here. This may be useful, for example, when the stiffening members 32 and 36 are made of a material (e.g. certain metals) to which the PVC sheet 24 cannot be readily welded. The lower PVC sheet 26, which is less heavily exposed to environmental loading, is adhesively bonded to the stiffening members 32 and 36 in the present case. Alternatively, it could also be vulcanised on. In the case of the stiffening member 32, therefore, the right-hand web 40 and the connecting section 54 each have at the same height a catch projection 84 and 86, respectively, which run in the longitudinal direction of the stiffening member 32 and behind which a catch spring 88, likewise extending over the entire length of the stiffening member 32, is clamped.

The border of the PVC sheet 24 is clamped between the catch spring 88 and the catch projections 84 and 86 and thereby fixed to the stiffening member 32. Analogously to this, in the connecting section 60 and the extension 62 of the stiffening member 36 there is formed in each case a catch projection 90 and 92, respectively, behind which a catch spring 94 is clamped, thereby firmly connecting the upper PVC sheet 24 to the stiffening member 36.

Furthermore, the stiffening member 36 has two rectangular hollow sections 96 and 98, on which the likewise hollow catch protuberance 78 is integrally formed. Furthermore, the anchoring elements 66, by means of which a secure connection of the stiffening member 36 to the core 22 is produced, are of T-shaped design. Finally, in the upper flange 42 of the stiffening member 32 there is provided a hollow space 100, likewise extending in the longitudinal direction. The design of the stiffening member 36 with the two hollow sections 96 and 98 leads to a weight reduction while at the same time providing high rigidity. The same applies to the hollow space 100 in the stiffening member 32.

Also illustrated in FIG. 4 is an additional element 102 which is passed through the interspace between the border regions 30 and 34 of the two covering parts 16 with its border region and is hung into the catch recess 76, free in FIG. 4, of the stiffening member 32 with a bent border section 104. The additional element 102 may, for example, be a snow fence, a ladder or steps. In this way, such an additional element 102 can be fastened in a simple way without the need for openings through the covering part 16.

Figure 5:
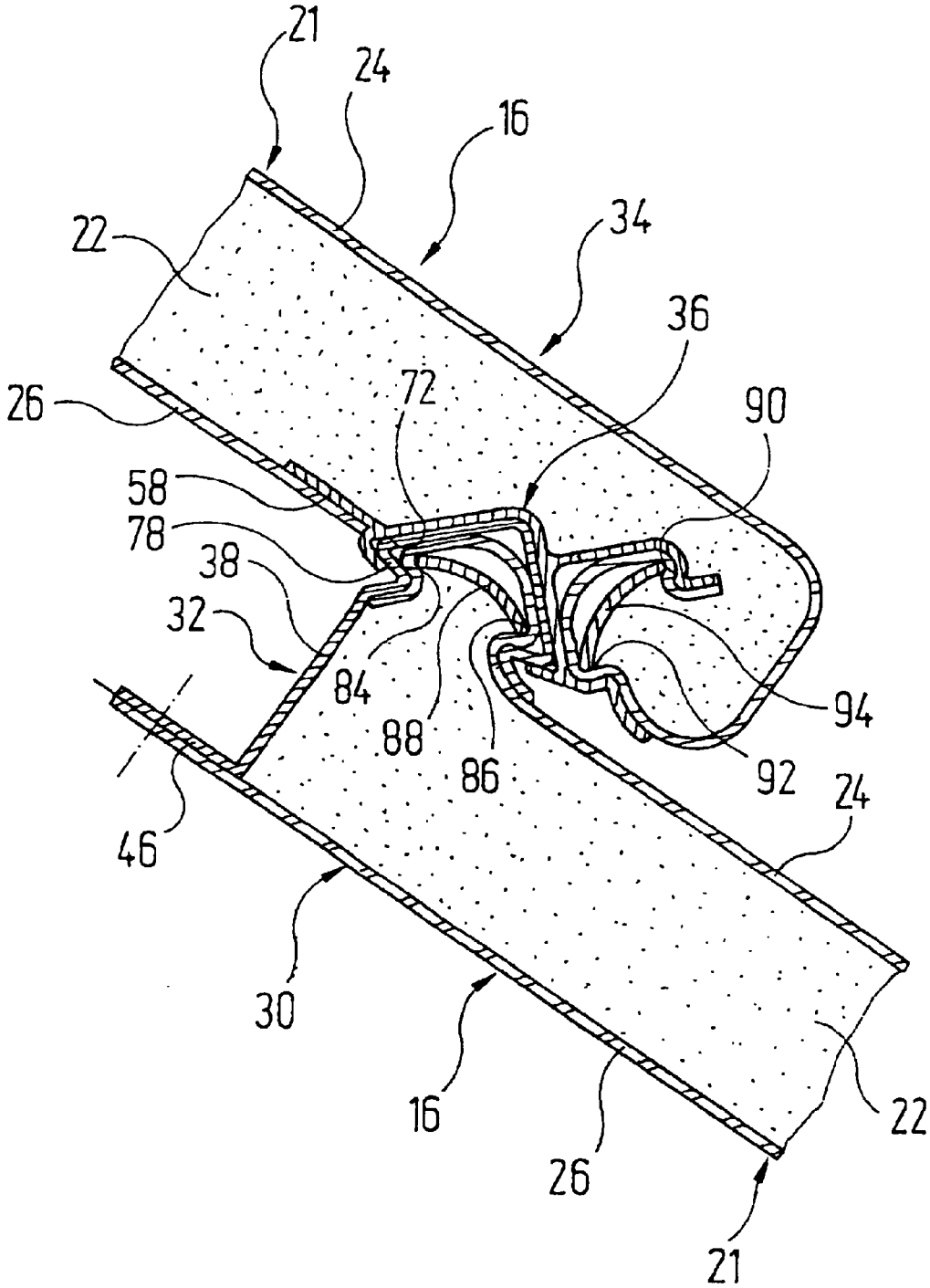
FIG. 5 shows a view similar to FIG. 3 of a third exemplary embodiment of a covering arrangement.

A third exemplary embodiment of a covering part 16 is illustrated in FIG. 5. Here, too, parts which are functionally equivalent to those parts of the previous exemplary embodiments bear the same reference numerals and are not explained in detail once again.

The exemplary embodiment of a covering part 16 illustrated in FIG. 5 is a simplified embodiment having straight border regions 30 and 34 which are thus not drawn downwards or upwards. The stiffening members 32 and 36 are also of a simpler construction. For example, the stiffening member 32 has no hollow section but only a single web 38. Furthermore, a plurality of side-by-side catch recesses are not provided, but only a single catch recess 72, with the result that the relative position of neighbouring covering parts 16 cannot be varied. Such a covering part 16 is simpler and less expensive to produce.

What is claimed is:

1. A covering arrangement for a building, the arrangement having parallel elongate supports and, arranged on the supports, covering parts which a) comprise a core and, connected thereto, upper and lower planar covering elements in the manner of a sandwich, b) have an elongate, striplike form, c) in the installed position are arranged transversely to the supports and extend at least from one support to a neighboring support, wherein d) a longitudinal border region (30) of a first covering part (16) has a first connecting device (68) and a longitudinal border region (34) of a second covering part (16) has a second connecting device (70) complementary to the first connecting device, by means of which the first and second covering parts (16) are firmly connected to each other;

e) the first connecting devices (68,) further comprising a plurality of adjacent connecting position recesses and the second connecting device (70) comprising at least one catch projection (78) complementary to each of the connecting position recesses, such that f) the relative position of the first covering part (16) with respect to the second covering part (16) can be varied.

2. A covering arrangement as claimed in claim 1, said arrangement being a roof (10) and said supports being rafters (14) of the roof (10).

3. A covering part in a covering arrangement as claimed in claim 1, which a) comprises a core and, connected thereto, upper and lower planar covering elements in the manner of a sandwich, and b) has an elongate, striplike form, wherein c) one longitudinal border region (30) has a connecting device (68) and the opposite longitudinal border region (34) has a connecting device (70) complementary thereto, such that the covering part (16) can be firmly connected to an identical covering part (16) at, in the installed position, mutually facing longitudinal border regions (30, 34).

4. A covering arrangement as claimed in claim 2, wherein the first and second connecting devices (68, 70) in the installed position cooperate in the manner of a hinge having a pivot axis, the pivot axis running substantially parallel to the longitudinal axis of the covering part (16).

5. A covering arrangement as claimed in claim 2, wherein at least one of the first and second connecting devices (68, 70) is integrated into a stiffening member (32, 36) arranged in a region of the corresponding longitudinal border region (30, 34) of said covering part.

6. A covering arrangement as claimed in claim 2, wherein at least one covering part comprises a length and a width, and the first and second connecting devices (68, 70) each extend over the entirety of the width of the covering part.

7. A covering arrangement as claimed in claim 2, wherein the first and second connecting devices (68, 70) are designed in such a way that, in the installed position, the mutually facing longitudinal border regions (30, 34) of the first and second covering parts (16) at least regionally overlap.

8. A covering arrangement as claimed in claim 7, at least one covering part comprising at least two longitudinal borders, wherein at least one of the longitudinal borders (34) is drawn down.

9. A covering arrangement as claimed in claim 2, at least one covering part comprising at least two longitudinal borders, wherein at least one of the longitudinal borders (30) is drawn up.

* * * * *